US005322051A

United States Patent [19]

Patterson et al.

[11] Patent Number: 5,322,051

[45] Date of Patent: Jun. 21, 1994

[54] HINGED BLOWER ACCESS DOOR WITH BLOWER SWITCH ACTIVATION

[75] Inventors: Randel K. Patterson, Plainfield; Allen L. Sherven, Brownsburg; Scott A. Beck; Robert C. Swilik, Jr., both of Indianapolis, all of Ind.

[73] Assignee: Carrier Corporation, Syracuse, N.Y.

[21] Appl. No.: 119,039

[22] Filed: Sep. 9, 1993

[51] Int. Cl.[5] ..... F24H 3/02

[52] U.S. Cl. ..... 126/110 R; 126/116 A

[58] Field of Search ..... 126/110 R, 116 R, 99 R, 126/116 A, 112, 117, 286, 287, 190, 110 A, 114

[56] References Cited

U.S. PATENT DOCUMENTS

| | | | |
|---|---|---|---|
| 3,956,674 | 5/1976 | Farley | 126/110 R |
| 4,343,290 | 8/1982 | Flatte | 126/110 E |
| 4,964,392 | 10/1990 | Bruno et al. | 126/21 A |

*Primary Examiner*—James C. Yeung

[57] ABSTRACT

A front access door suitable for accessing and enclosing a housing within a multipoise furnace functions in conjunction with a safety shutoff switch to provide greater access and safety when assembling and servicing the furnace. The front access door is hingably supported upon the bottom wall of the housing for removal from the furnace and rotation between a closed position and an opened position. The shutoff switch is mounted outside the housing on the top housing wall. When the access door moves into a closed position, a switch activator, mounted to the access door, passes over the top housing wall and closes the switch, thereby allowing power to flow to a blower within the housing. When the access door is moved into an open position, the switch activator opens the switch, thereby terminating power to the blower.

4 Claims, 2 Drawing Sheets

HINGED BLOWER ACCESS DOOR WITH BLOWER SWITCH ACTIVATION

BACKGROUND OF THE INVENTION

This invention relates to a multipoise furnace and, specifically, to a hinged front access door and a safety shutoff switch within a multipoise furnace.

The term multipoise furnace, as herein used, refers to a furnace that can be positioned on either its bottom, top, left side or right side such that the furnace may discharge air in either an upward or downward direction, as well as horizontally to the left or to the right. While most furnaces that may be installed in different positions require extensive modifications when changing orientation, the ability to selectively position a the multipoise furnace exists without modification.

A multipoise furnace includes a blower that draws return air from a comfort zone into a blower housing and forces the air throughout the furnace. Access into the blower housing typically has been achieved by providing an access door that is permanently attached to the furnace. Such an access door, however, may restrict complete access to the blower and complicate assembly of the furnace.

Also associated with the blower housing is the safety shutoff switch. Upon opening the access door, the shutoff switch terminates power to the furnace's control center, causing all components to become temporarily inoperative. If the switch fails to render the blower inoperative, maintenance becomes dangerous as the technician is exposed to an operating blower and its power supply. Furthermore, if the switch fails or does not terminate power immediately upon opening the access door, inefficient operation and early deterioration of the furnace results as unfiltered air enters and deposits throughout the furnace. Failure of the shutoff switch to properly terminate blower operation, however, exists as a probable result when placement of the switch within the housing exposes it to grease, dirt, and the possibility of accidental activation when working within the housing.

SUMMARY OF THE INVENTION

It is therefore an object of the present invention to improve the efficiency and usable life of a multipoise furnace.

A further object of the present invention is to improve the safety of operating and maintaining a multipoise furnace.

A still further object is to improve access into the blower housing of a multipoise furnace.

Another object of the present invention is to provide an improved front access door for use in assembling and servicing a multipoise furnace.

Still another object is to provide an improved safety shutoff switch for use in conjunction with the improved front access door within a multipoise furnace.

These and other objects of the present invention are attained by a front access door, which is suitable for accessing and enclosing the blower housing within a multipoise furnace, functioning in conjunction with a safety shutoff switch, mounted upon the top housing wall, and a switch activator, mounted on the access door. Specifically, the access door is hingably supported on the bottom wall of the housing for rotation between a fully closed position, wherein the housing components are completely enclosed, and a fully open position, wherein the housing components are completely accessible. Furthermore, the hinge upon which the access door is supported allows the access door to be completely removed from the housing.

The switch activator, which is mounted to the access door, enables the access door to cooperate and function with the shutoff switch. When the access door moves into a closed position, a switch activator, mounted to the access door, passes over the top housing wall and closes the switch, thereby allowing power to flow to a blower within the housing. When the access door is moved into an open position, the switch activator opens the switch, thereby terminating power to the blower.

BRIEF DESCRIPTION OF THE DRAWINGS

For a better understanding of these and other objects of the present invention, reference will be made to the following detailed description of the invention which is to be made in association with the attached drawings whereby.

DESCRIPTION OF THE INVENTION

Figure 1:
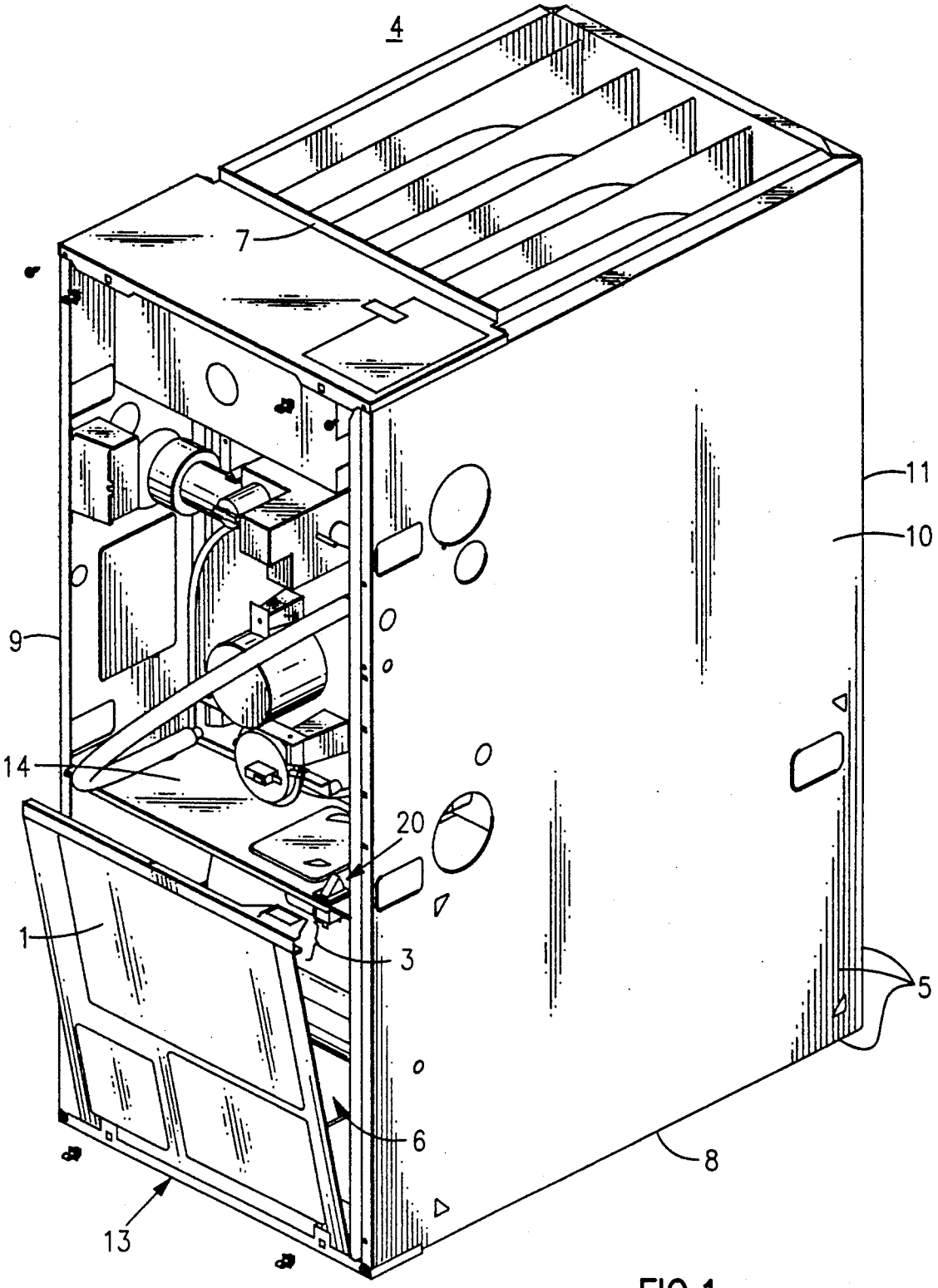
FIG. 1 is a perspective view of a multipoise furnace with the front furnace panel removed showing a hinged front access door 1, a safety shutoff switch 2, and a switch activator 3, all of which embody the teachings of the present invention.
Figure 2:
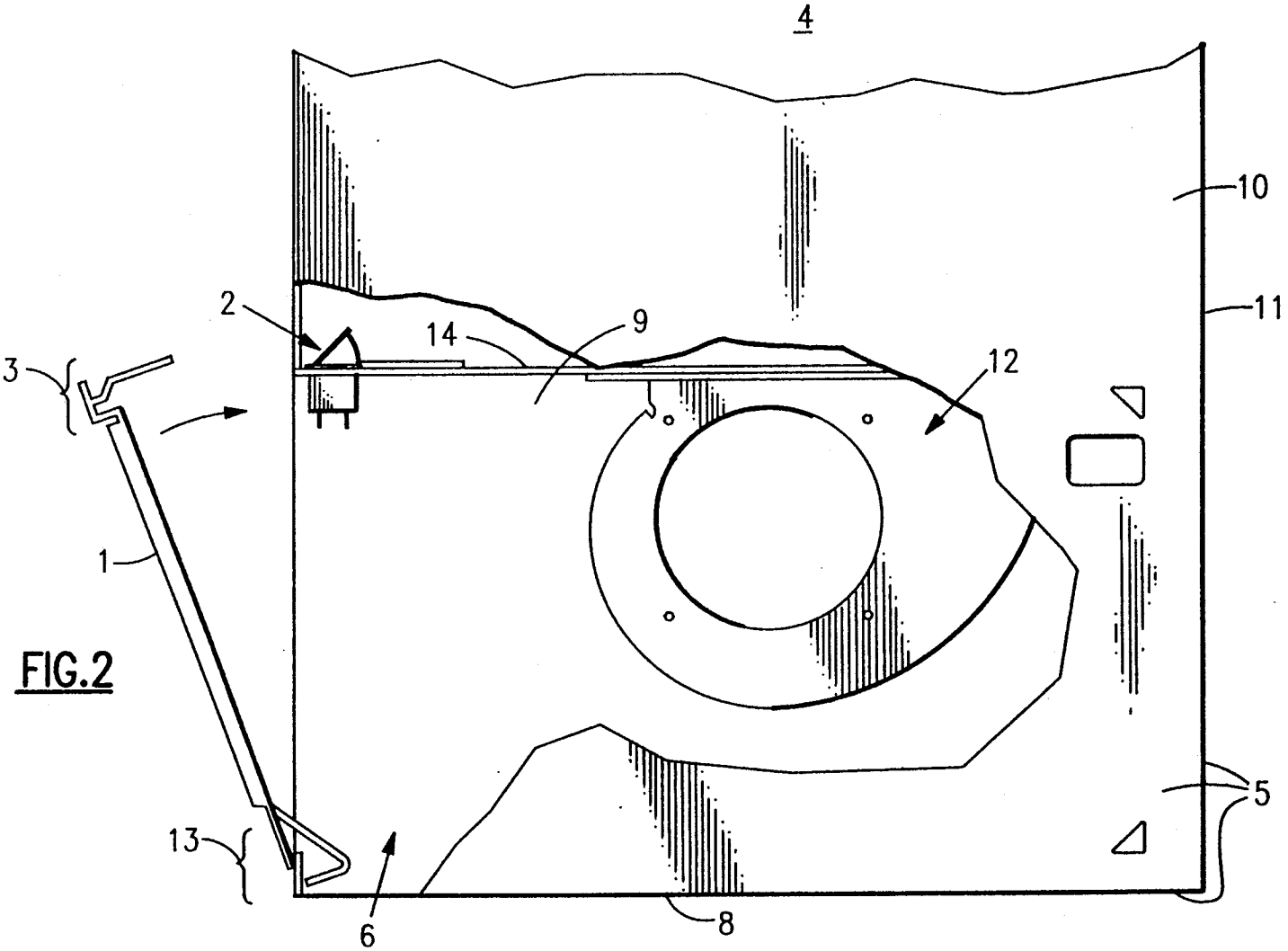
FIG. 2 is a side elevational view of a blower housing 6 showing the hinged front access door 1, the safety shutoff switch 2, and the switch activator 3, all of which embody the teachings of the present invention.

Referring initially to FIG. 1 and FIG. 2, there is illustrated a multipoise furnace, generally referenced 4, housed within a rectangular enclosure, 5, the front of which is not shown. The furnace 4 is shown in an upflow orientation wherein a blower, shown only in FIG. 2 as 12, draws return air into the blower housing 6, from a comfort zone and forces it through the furnace 4 for discharge through the top, 7.

Although not shown, the return air entrance may be selectively located in either the bottom 8, side 9, 10, or back wall 11 of the housing 6. Furthermore, by selectively positioning the return air entrance, the furnace 4 may be oriented in one of a number of positions. These positions include an upflow orientation as shown in FIG. 1 and FIG. 2, wherein air is discharge from the top 7, and a downflow orientation wherein the furnace 4 is inverted for downward discharge of air. Also, the furnace 4 may be oriented on its left side 9 for horizontal discharge to the left, or the furnace 4 may be oriented on its right side 10 for horizontal discharge to the right. Conforming with the above definition of multipoise furnace, each of the components of the present invention, including the front access door 1, the safety shutoff switch 2, and the switch activator 3, must be capable of functioning in each of the noted orientations of the furnace 4 without modification.

The major components and structures of the furnace 4 which relate to the present invention are shown in FIG. 1 and FIG. 2. These include an enclosed housing 6 formed by a top wall 14, a bottom wall 8, two opposing side walls 9, 10, a back wall 11, and a front access door 1. Within this housing 6 and attached to the top wall 14 is the blower 12, which draws air into the housing 6 and forces it through the furnace 4. The front access door 1 hinges upon the bottom wall 8 for rotation between a fully closed position and a fully open position.

In a fully closed position, the access door 1 effectively seals the housing 6 causing the blower, shown in FIG. 2 as 12, to draw air into the housing 6 primarily through a filtered return air entrance, not shown. A hinge assembly 13 of the access door 1 ensures complete closure by preventing separation of the bottom of the access door 1 and the bottom wall 8 of the housing 6.

The hinge assembly 13 forms an extension of the access door 1, extending in the same plane as the access door 1 toward the bottomwall 8 of the housing. One portion of the door extension is inclined away from the door 1 toward the back housing wall 11 and then angles forward to a point at the back of the door, thereby forming a peripheral surface of the door. The door extension, thus forms a retaining channel with the inclined section of the door extension, for containing an extension of the bottom housing wall 8, thereby creating a means for rotatably supporting the access door 1.

In a fully open position the access a , door 1 provides complete access into the housing 6. In addition to allowing the access door 1 to rotate into a fully open position, the hinge assembly 13 allows the access door 1 to be completely removed from the housing 6 and furnace 4. The ability to remove the door not only enhances access into the housing 6 during furnace maintenance, but also simplifies installation of housing components during furnace assembly.

Also shown in FIG. 1 and FIG. 2 is a safety shutoff switch 2. The location of the switch 2, namely outside the housing 6 on the top housing wall 14, functions to protect the switch 2 from the grease and particles found within the housing 6. In the absence of such grease and particles, furnace efficiency and safety increase because longer switch life and greater switch reliability are likely.

Furthermore, placing the switch 2 on the top wall 14 of the housing preserves the multipoise capability of the furnace 4. The back, bottom, and side walls of the housing 6 are also sections of the furnace's rectangular outer enclosure 5. Therefore, placement of the switch 2 on the outside surface of a housing wall other than the top would prohibit the furnace 4 from sitting level when oriented on that side.

The use of the hinged front access door 1 to increase accessibility into the housing 6 and the placement of the shutoff switch 2 outside the housing 6 on the top wall 14 of the housing 6 to increase efficiency and safety creates the need for a switch activator 3. The switch activator 3 includes a door offset mounted to the top edge of the access door 1 and extending past the top housing wall 14. A flange is mounted to the door offset and extends normally inwardly to an extent which renders it capable of depressing and enclosing the shutoff switch when the access door is in a closed position, and of releasing and opening the shutoff switch when the access door 1 is pivoted to the open position. The switch activator 3, mounted on the upper edge of the access door 1, exists so that the new access door functions in cooperation with the newly positioned shutoff switch 2. Specifically, when the door 1 hinges closed, the switch activator 3 passes over the top housing wall 14 and closes the shutoff switch 2. In this position, the switch 2 opens power to the furnace controls, permitting blower operation. When the door 1 hinges towards an open position, the activator 3 opens the switch 2 thereby terminating power flow and blower operation.

Functioning in combination, the front access door 1, the shutoff switch 2, and the switch activator 3 further act to improve furnace operation. In particular, the location of the switch 2 and switch activator 3 relative to the position of the front door hinge 13 prolongs the life of the furnace. This is true because for any angle the access door 1 hinges open, the arc swung by the top of the door and, therefore, the switch activator 3, exceeds that which is swung by any other point on the door 1. It follows that minimal angular rotation of the front access door 1 is required for the switch activator 3 to open the switch 2. Therefore, this safety shutoff switch 2 terminates power to the blower 12 virtually immediately upon moving the access door 1 to an opened position, and blower operation ceases before damaging unfiltered air can be sent through the furnace 4.

As should be evident from the disclosure above, the hinged front access door 1, the safety shutoff switch 2, and the switch activator 3 of the present invention provide certain advantages over similar devices found in the prior art. First, the hinged front access door 1 configured so that the components within the housing 6 are easily accessible during assembly and servicing, despite furnace orientation. Secondly, the safety shutoff switch 2, with which the hinged front access door 1 and switch activator 3 are designed to function, is mounted outside the housing 6 upon the top housing wall 14, thereby ensuring a cleanlier operating environment and safer, more efficient furnace operation.

While this invention has been explained with reference to the structure disclosed herein, it is not confined to the details set forth, and this invention is intended to cover any modifications and changes as may come within the scope of the following claims:

What is claimed is

1. In a multipoise furnace having a blower means for moving return air through the furnace that includes an enclosed housing within the furnace having top and bottom walls, two opposing side walls, and front and back walls, said blower means supported in the top wall of said housing, said front wall having an opening for providing access into said housing and accommodating a front access door means, said front access door means hinged to said bottom housing wall for removal from said furnace and rotation between an open position wherein said blower means is accessible and a closed position wherein said front door is flush against the front wall to fully close said opening, a safety shutoff switch means mounted outside said housing upon said top housing wall for opening and closing a circuit means for operating said blower means, and a switch activator means attached to the top of said access door for passing over the top wall of said housing and closing said shutoff switch means when the door is in a fully closed position and opening said shutoff switch means when said access door is moved towards said open position.

2. The apparatus of claim 1 wherein said front access door means includes a hinge means comprising an extension of said access door extending in the same plane of said access door toward the bottom wall of said housing, a section of said door extension being inclined away from said door towards said back housing wall and then angling forward to a point to the back of said door thereby forming a peripheral surface of said door, and said door extension forming a retaining channel with said inclined section of said door extension for containing an extension of said bottom housing wall, thereby creating a means for rotatably supporting said access door.

3. The apparatus of claim 1 wherein said switch activator means comprising a door offset mounted to the top edge of said access door which extends past said top housing wall, a flange mounted to said door offset capable of depressing and closing said shutoff switch when said access door is in a closed position and capable of releasing and opening said shutoff switch when said access door is pivoted to the open position.

4. The apparatus of claim 1 wherein said safety shutoff switch comprising an inclined contact surface slidably depressible by said switch activating means when said access door is pivoted into the closed position.

* * * * *